US011187054B2

(12) United States Patent
Akhare et al.

(10) Patent No.: US 11,187,054 B2
(45) **Date of Patent: *Nov. 30, 2021**

(54) BOP BOOSTER PISTON ASSEMBLY AND METHOD

(71) Applicant: WORLDWIDE OILFIELD MACHINE, INC., Houston, TX (US)

(72) Inventors: Prashant N. Akhare, Stafford, TX (US); Dennis D. George, Cypress, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/190,665

(22) Filed: Nov. 14, 2018

(65) Prior Publication Data

US 2019/0078411 A1 Mar. 14, 2019

Related U.S. Application Data

(63) Continuation of application No. 15/018,056, filed on Feb. 8, 2016, now Pat. No. 10,190,382.

(Continued)

(51) Int. Cl.
*E21B 33/06* (2006.01)
*E21B 29/08* (2006.01)

(52) U.S. Cl.
CPC ..... *E21B 33/063* (2013.01); *E21B 29/08* (2013.01); *Y10T 137/5983* (2015.04)

(58) Field of Classification Search
CPC .... F16K 51/00; F16K 31/122; F16K 31/1225; Y10T 137/5983; E21B 29/08;

(Continued)

(56) References Cited

U.S. PATENT DOCUMENTS 3,561,526 A 2/1971 Williams, Jr.
4,044,988 A * 8/1977 Arzumanov ..... E21B 33/062 251/1.3

(Continued)

FOREIGN PATENT DOCUMENTS

CN 201865613 6/2011
SU 1008416 3/1983

OTHER PUBLICATIONS

International Search Report and Written Opinion, PCT/US2016/056807, International Search Authority, dated Feb. 16, 2017.

*Primary Examiner* — Craig J Price
*Assistant Examiner* — Andrew J Rost
(74) *Attorney, Agent, or Firm* — Kenneth L. Nash; Thomas O. Nash

(57) ABSTRACT

A BOP booster assembly is provided for use with BOPs that utilize hydraulic actuators mounted in BOP end caps to open the BOP for replacement of the shearing members. The booster assembly has three main components comprising a booster housing, piston, and end plate. An extension in the booster housing is sufficiently long to position the booster hydraulic cylinder axially outside of the ends of the bonnet end caps of the BOP with respect to the wellbore. The booster piston is equal in diameter or larger than the operating piston of the BOP. The operating pistons and booster pistons move simultaneously, in sync, and the same distance for closing and cutting. In one embodiment, an internal hydraulic line is provided in the booster cylinder wall.

17 Claims, 8 Drawing Sheets

Related U.S. Application Data

(60) Provisional application No. 62/243,782, filed on Oct. 20, 2015.

(58) Field of Classification Search
CPC .... E21B 33/0355; E21B 33/06; E21B 33/061; E21B 33/062; E21B 33/063
See application file for complete search history.

(56) References Cited

U.S. PATENT DOCUMENTS

| | | | | |
|---|---|---|---|---|
| 4,437,643 | A | 3/1984 | Brakhage, Jr. | |
| 4,492,359 | A | 1/1985 | Baugh | |
| 5,178,360 | A | 1/1993 | Young | |
| 5,205,200 | A | 4/1993 | Wright | |
| 5,653,418 | A | 8/1997 | Olson | |
| 6,244,560 | B1 | 6/2001 | Johnson | |
| 6,969,042 | B2 | 11/2005 | Gaydos | |
| 7,374,146 | B2 | 5/2008 | Whitby et al. | |
| 9,140,090 | B2 * | 9/2015 | Van Wijk | E21B 33/0355 |
| 10,190,383 | B2 * | 1/2019 | Mullin | E21B 43/16 |
| 2005/0242308 | A1 | 11/2005 | Gaydos | |
| 2009/0127482 | A1 | 5/2009 | Bamford | |
| 2017/0107779 | A1 | 4/2017 | Akhare et al. | |

* cited by examiner

BOP BOOSTER PISTON ASSEMBLY AND METHOD

This application is a continuation of U.S. application Ser. No. 15/018,056 filed Feb. 8, 2016, and said U.S. application Ser. No. 15/018,056 claims benefit of U.S. provisional application No. 62/243,782 filed Oct. 20, 2015, both of which is are incorporated herein in their entirety.

BACKGROUND OF THE INVENTION

Field of the Invention

The present invention relates generally to BOP piston booster assemblies for shear rams and, more particularly, to a BOP booster piston assembly mounted between hydraulic actuators in bonnet end caps that contain hydraulic pistons used to open the rams to change out the shear members.

Background of the Invention

Blowout Preventers ("BOP") are frequently utilized in oilfield wellbore for pressure control involving shearing tubulars and closing off a wellbore. A BOP, or a BOP stack, may include a first set of rams for sealing off the wellbore and a second set of shear rams for cutting pipe such as tubing, wireline and/or intervention tools. Many different sets of rams may be utilized. BOP stacks can be quite bulky and heavy expensive. With increasing size, BOP stacks typically become much more expensive for initial cost as well as for installation and removal.

Shear ram BOPs may frequently require maintenance after cutting pipe. In order to open the BOPs to change the shear members, hydraulic actuators located within bonnet end caps may be utilized.

BOPs utilize hydraulic pistons, referred to herein as operating pistons, to operate the rams, including the rams that utilize shearing members. The operating pistons for the BOP are often mounted between the bonnet end caps that contain hydraulic pistons utilized to open the bonnets for access to the shearing members. For this reason, the diameter of the hydraulic pistons utilized to operate the shearing pistons for these types of BOPs is limited.

To cut larger pipe than can be cut by the operating pistons utilizing the maximum or optimum practical hydraulic fluid pressure, booster piston assemblies have been utilized in the past that are utilized in addition to the operating pistons. However, when the operating pistons are positioned between the bonnet end caps, and the booster pistons are mounted axially thereto, the booster piston assemblies have been limited in size due to the bonnet end caps. Accordingly, these types of prior art booster piston assemblies are also limited in diameter, which in turn limits the amount of force that can be produced by the booster pistons.

Further, the addition of booster piston assemblies on either side of the BOP results in the need to add hydraulic lines that may be exposed to damage due to moving elements that may hit the BOPs and damage the hydraulic lines (e.g. items being lifted).

The following patents discuss background art related to the above discussed subject matter including examples of prior art booster piston assemblies:

U.S. Pat. No. 6,244,560, issued Jun. 12, 2001, to Chris Johnson, discloses a ram actuating mechanism for a blowout preventer, the ram actuating mechanism including a hydraulic booster for enhancing the ram closing force. The ram actuating mechanism may be compatible for use with primary pistons which include internal moving components, such as self locking pistons. The ram actuating mechanism provides a hydraulic booster without increasing the diameter of the booster pistons above the diameter of the primary piston, such that BOP stack height need not be increased to accommodate a relatively large diameter hydraulic booster. The ram actuating mechanism may utilize the same piston housing as used by the primary piston, and the booster pistons may act mechanically in series upon the primary piston to increase axial ram closing force. The ram actuating mechanism may be capable of retro-fitting to existing ram actuating mechanisms.

U.S. Pat. No. 5,178,360, issued Jan. 12, 1993, to Terry Young, discloses a valve actuator or a booster module for an existing valve actuator that provides an incremental force to the valve stem at a position close to valve closure. The force is stored in a spring which is held in the compressed position by a collet. Upon sufficient movement of the valve actuator stem in the direction towards valve closure, the collet which had previously held the spring in a compressed position is freed to move to allow the spring to expand against the collet. Since movement of the collet has caused it to be engaged to the valve actuator stem, the spring forces are transmitted directly to the valve actuator stem via the collet. The spring is oriented in a direction substantially parallel to the valve stem so that substantially all of its retained energy is transmitted directly to the valve stem through the collet.

U.S. Pat. No. 5,205,200, issued Apr. 27, 1993, to John J. Wright, discloses a linear actuator used in moving, for example, gate valves, sluice gates and the like, wherein an increased thrust is required during initial movement. The present invention includes, as part of the linear actuator, a booster piston movably disposed about a piston rod; further included on the booster piston is a thrust column disposed radially between the booster piston and the piston rod so as to define an annular fluid channel for enabling fluid to move upwardly so as to contribute a substantial additional thrust component to move the primary piston.

U.S. Pat. No. 6,969,042, issued Nov. 29, 2005, to Stephen Gaydos, discloses a blowout preventer with a main body; a base releasably connected to the main body, the base having a base space therein, the base having a ram shaft opening; a primary piston movably disposed within the base space; a ram shaft to which the primary piston is connected, the ram shaft including a ram end and a piston end; a ram connected to the ram end of the ram shaft; a housing connected to the base, the housing having a housing space therein, the housing including a middle member with a member opening; a booster piston movably disposed within the housing space and having a booster shaft projecting therefrom and a booster shaft space therein; the shaft including a push portion selectively movable to abut the ram shaft to prevent movement of the ram shaft and to transfer force of the booster piston to the primary piston; and power fluid apparatus for the primary piston and the booster piston.

U.S. Pat. No. 7,374,146, issued May 20, 2008, to Whitby et al., discloses a hydraulic blowout preventer operator comprises a first piston rod coupled to a closure member. The operator further comprises a first operator housing coupled to a bonnet and a head. The first piston rod extends through the bonnet into the first operator housing where is couples to a first piston disposed within the first operator housing. The operator further comprises a second piston rod coupled to the closure member. The second piston rod has a longitudinal axis that is parallel to a longitudinal axis of the first piston rod. The second piston rod extends through the bonnet into a second operator housing and is coupled to a second piston that is disposed within the second operator housing.

Chinese Patent No. CN 201865613, issued Jun. 15, 2011, to Shanghai SK Petroleum & Chemical Equipment Corporation Ltd., discloses a combined oil cylinder for a ram preventer with a shearing function. The combined oil cylinder comprises a side door, a ram control hydraulic cylinder assembly, a shearing boosting hydraulic cylinder assembly and a hydraulic cylinder cover which are sequentially connected and installed. The ram control hydraulic cylinder assembly comprises a ram control hydraulic cylinder, a ram control piston and a ram control piston rod. The shearing boosting hydraulic cylinder assembly comprises a boosting hydraulic cylinder, a boosting piston and a boosting piston rod. The combined oil cylinder for the ram preventer with the shearing function provided by the present utility model ensures that the size and the weight of the ram preventer of a hinge switch side door are not increased, can simultaneously effectively increase the pushing force of the piston rod to shear a tube string in a well.

The above prior art does not disclose a booster piston assembly as described in the present specification. Consequently, those skilled in the art will appreciate the present invention that addresses the above and/or other problems.

SUMMARY OF THE INVENTION

An object of the present invention is to provide an improved BOP booster piston assembly and method.

Yet another possible object of the present invention is to provide a BOP booster assembly that can be retrofitted onto existing BOP's.

Yet another possible object of the present invention is to provide a BOP booster piston that allows a smaller diameter BOP that can be utilized to cut pipe that in the past required a much larger and typically much more expensive BOP.

Yet another possible object of the present invention is to provide a method or system that provides a booster piston assembly for a 13⅝ BOP to make the BOP operable to cut the tubular portion of at least 5½ OD tubing, 24.7 ppf, ½ inch wall thickness, and S135 (rated to 135,000 psi).

Yet another possible object of the present invention is to provide a booster piston that is at least as large as or larger than the operating piston in diameter. The operating piston is the piston (or one of two pistons) on each side of the BOP.

Yet another possible object of the present invention is to provide a booster hydraulic piston housing that has a larger OD than the distance between the bonnet end caps and is positioned beyond the bonnet end cap.

Yet another possible object of the present invention is to provide that an internal hydraulic line connects the back side of both the operating piston and the booster piston to hydraulic fluid flow for closing and cutting purposes.

Yet another object of the present invention is to provide that the operating and booster pistons move simultaneously, in sync, and the same distance for closing and cutting, and that sealing depends on shearing members.

These and other objects, features, and advantages of the present invention will become clear from the figures and description given hereinafter. It is understood that the objects listed above are not all inclusive and are only intended to aid in more quickly understanding the present invention, not to limit the bounds of the present invention in any way.

Accordingly, a booster piston assembly is provided for use with a BOP. The BOP comprises a central body. On one side of the BOP is a shear member and an operating piston to move the shear member between an open and closed position. The BOP is of a type wherein each bonnet on each side comprises two bonnet end caps. The two bonnet end caps contain hydraulics to open one of the bonnets for access to an interior of the central body. The operating piston is mounted between the two bonnet end caps within an operating piston chamber. The operating piston chamber comprises an operating piston chamber outer wall.

In one embodiment, the booster piston assembly comprises a booster piston housing with a booster housing extension and a booster cylinder wall that defines therein a booster piston chamber. The booster piston housing may further comprise a booster flange adapted to be mounted to the operating piston chamber outer wall. The booster flange, the booster housing extension, and the booster cylinder wall may be monolithically formed as a metallic construction in a preferred embodiment.

A booster piston is mounted for reciprocal movement inside the booster piston chamber. The booster piston assembly may further comprise a booster inner piston shaft and a booster outer piston shaft on opposite sides of the booster piston. In one embodiment, the booster inner piston shaft, the booster piston, and the booster outer piston shaft are monolithically formed as a metallic construction.

The booster piston assembly may further comprise a booster housing end plate with a booster piston chamber outer wall, a booster end plate flange, and a booster end plate housing. The booster outer piston shaft extends into the booster end plate housing. The booster inner piston shaft extends into the booster housing extension.

In one embodiment, the booster inner piston shaft is positioned to engage the operating piston shaft but is not fastened to the operating piston shaft when the booster piston housing is secured to the BOP.

The booster piston comprises a diameter at least as large as a diameter of the operating piston.

The booster cylinder wall encircling the booster piston chamber comprises an outer diameter greater than a minimum distance between the two bonnet end caps.

The booster flange and the booster housing extension comprise an axial length that positions the booster cylinder wall to be axially spaced from an outer end of the two bonnet end caps.

In one embodiment, the booster cylinder wall defines a hydraulic line therein that receives hydraulic fluid to move the operating piston to a closed position.

The booster flange, the booster housing extension, and the booster cylinder wall may be monolithically formed as a metallic construction.

In one embodiment, the booster piston assembly is adapted for use with a 13⅝" BOP whereby a diameter of the booster piston and the operating piston is utilized so that the BOP is operable to cut the tubular portion of at least 5½ OD tubing, 24.7 ppf, ½ inch wall thickness, rated to 135,000 psi.

In another embodiment, the BOP comprises a BOP hydraulic connector in communication with the BOP operating piston chamber so that the BOP hydraulic connector extending from the BOP operating piston chamber is adapted for connection to the booster hydraulic line connection.

The present invention provides a method for making or providing a booster piston assembly for use with a BOP as described herein.

Steps in one embodiment comprise providing a booster piston housing, providing that the booster piston housing comprises a booster housing extension and a booster cylinder wall that encircles a booster piston chamber, providing that the booster piston housing further comprises a booster flange adapted to be mounted to the operating piston chamber outer wall. Other steps comprise providing that the booster flange, the booster housing extension, and the booster cylinder wall are monolithically formed together. Other steps may comprise providing that the booster housing extension is positioned between the booster flange and the booster cylinder wall.

Other steps may comprise providing a booster piston mounted for reciprocal movement inside the booster piston chamber that has a diameter at least as large as or greater than a diameter of the operating piston.

Other steps may comprise providing a booster inner piston shaft and a booster outer piston shaft on opposite sides of the booster piston and providing that the booster inner piston shaft, the booster piston, and the booster outer piston shaft being monolithically formed of metal.

Other steps may comprise providing a booster housing end plate and further providing that the booster housing end plate comprises a booster piston chamber outer wall, a booster end plate flange, and a booster end plate housing. Other steps comprise providing that the booster outer piston shaft extending into the booster end plate housing, the booster inner piston shaft extends into the booster housing extension.

Other steps comprise providing that a booster inner piston shaft is positioned to engage the operating piston shaft but is not fastened to the operating piston shaft when the booster piston housing is secured to the BOP.

The method may further comprise providing that a circumference of the booster cylinder wall comprises an outer diameter greater than a minimum distance between the two bonnet end caps.

The method may comprise providing that the booster flange and the booster housing extension comprise an axial length that positions the booster cylinder wall axially spaced away from the two bonnet end caps when the booster piston housing is secured to the BOP.

The method further comprising forming within the booster cylinder wall a hydraulic line therein that receives hydraulic fluid to move the operating piston to a closed position.

BRIEF DESCRIPTION OF THE DRAWINGS

The above general description and the following detailed description are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
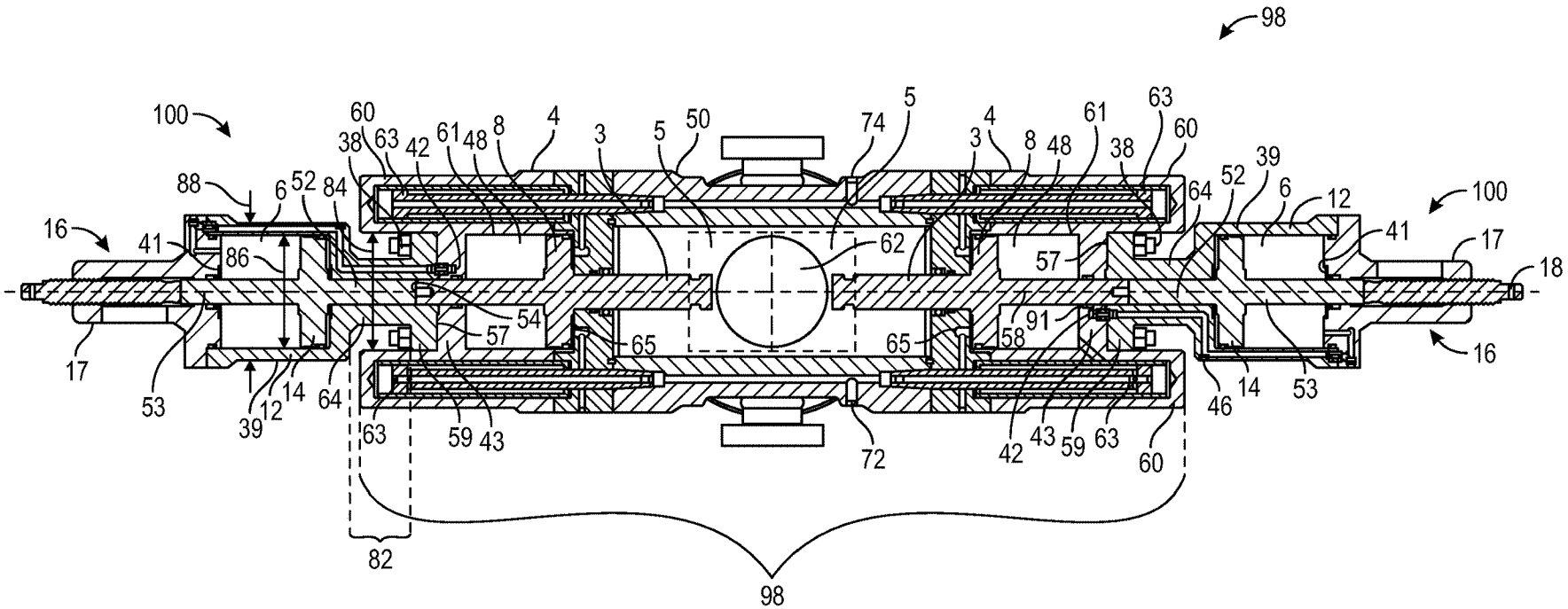
FIG. 1 is a plan view, in section, of a shear BOP with a booster piston assembly in accord with one possible embodiment of the present invention.
Figure 2:
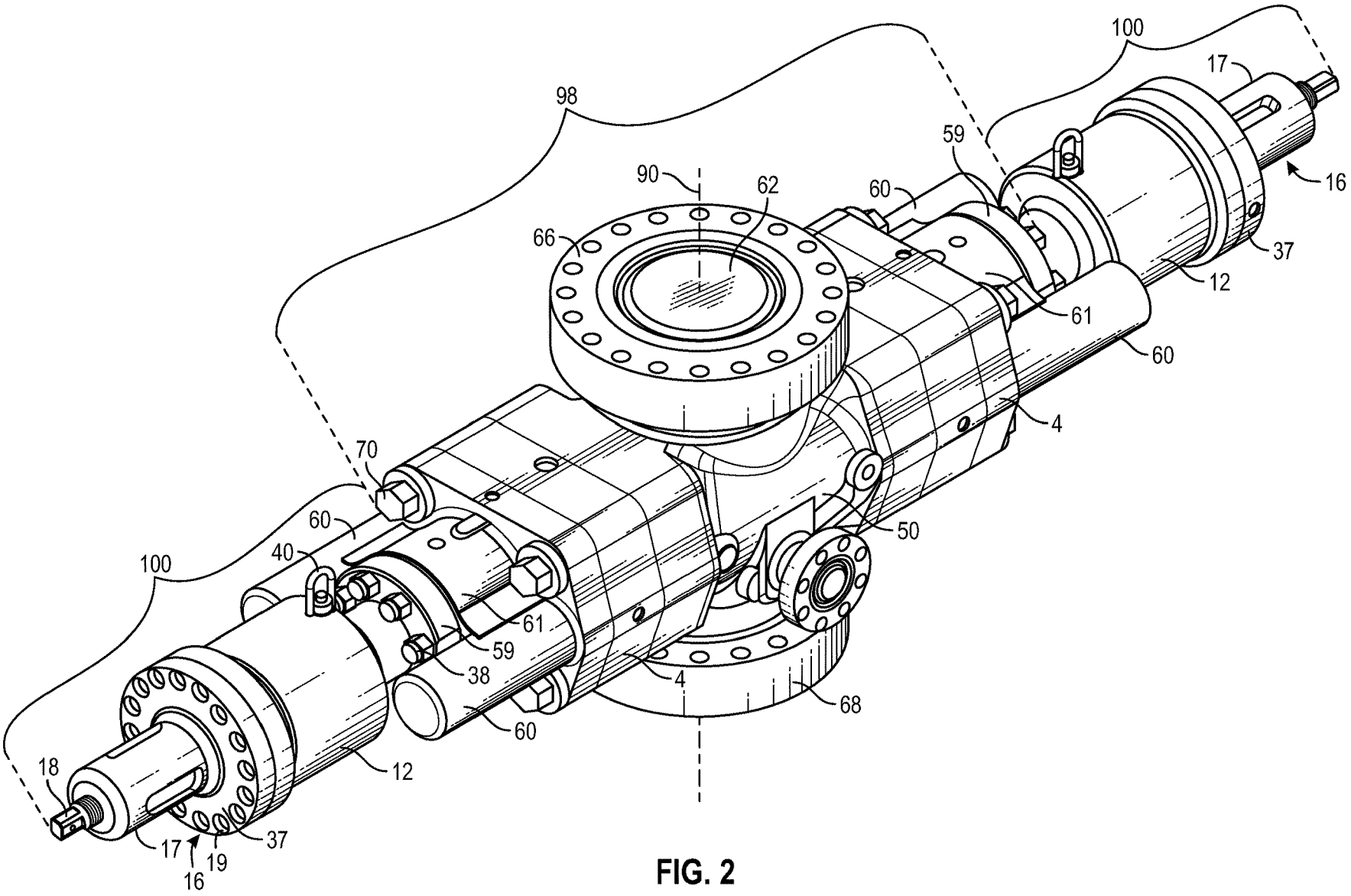
FIG. 2 is a perspective view of a shear BOP with booster piston assembly in accord with one possible embodiment of the present invention.

Referring now to the drawings and more particularly to FIGS. 1 and 2, there are shown BOP booster piston assemblies 100 arranged on either side of BOP 98 as illustrated in FIG. 1 and FIG. 2. BOP piston assembly 100 may be referred to herein as BOP booster assembly 100, BOP booster piston assembly 100, or the like. The two BOP booster piston assemblies on either side of the BOP are identical and the same numbers are used for like parts. It is necessary to discuss only one BOP booster piston assembly such as that shown in FIGS. 4 and 5. Likewise, both sides of the BOP are substantially the same so that in some cases only one side of the BOP and associated bonnet is discussed. In the claims, only one booster assembly and one side of the BOP may be described. See also FIG. 7 for BOP booster piston assembly 100A, which utilizes an external retrofit hydraulic line but nonetheless is the same booster piston assembly 100A on both sides of the BOP 98A.

The use of a booster piston assembly as described herein allows a smaller diameter BOP to cut pipe that in the past required a larger and more expensive BOP. For example in one embodiment, a booster piston assembly added to a 13⅝" BOP can make the BOP operable to cut the tubular portion of at least 5½ OD tubing, 24.7 ppf, ½ inch wall thickness, and S135 (rated to 135,000 psi). In this case BOP 98 or 98A may be a 13⅝" BOP with booster piston assembly 100 or 100A having the same operating and booster piston diameters of sufficient size to provide this enhanced shearing ability. In another embodiment, a 7¹⁄₁₆ inch BOP has the cutting capability of an 11" BOP thereby saving the cost by allowing use of a 7¹⁄₁₆ BOP instead of an 11" BOP. In this case, BOP 98 or 98A may be a 7¹⁄₁₆" BOP with booster piston assembly 100 or 100A having the same operating and booster piston diameters. However, the invention may be utilized in any size BOP such as but not limited to 7¹⁄₁₆", 11", 13⅝", 18¾", or 21¼ inch. When the BOP piston assembly is added, the additional shearing force may be in the range of twice as great so that testing of the assembly can be utilized to confirm the enhanced shearing ability.

Returning to FIG. 1 and FIG. 2, shear BOP 98 comprises BOP central housing 50 or body which surrounds wellbore 62. As shown in FIG. 2, upper and lower flanges 66 and 68 define wellbore 62 that extends through the BOP along axis 90. Push rods 3, which in one embodiment are monolithically formed of metal with a hydraulic piston, each carry a shear member. Shear members may be of many different configurations and are shown as shear members 5 (shown schematically in dash for clarity in the drawing) that connect to the push rods 3. The shear members 5 are pushed inwardly toward wellbore 62 to cut pipe within the wellbore and seal the wellbore in a well-known mariner. The shear members, pistons and push rods move axially along an axis of movement that is perpendicular to wellbore 62 and axis 90 therethrough. Axial lengths along this axis are frequently used herein to describe positions of the booster piston assembly components.

Bonnets 4, which comprise hydraulic chambers, are mounted on either side of central housing 50. Bonnets 4 can be opened hydraulically by the hydraulic mechanisms in end caps 60 to change out the shear members 5. Bonnets 4 carry corresponding operating piston housings 61 in which operating pistons 8 are mounted. Operating pistons 8 move reciprocally and are slidably mounted within operating piston housings 61 to move shear members 5 to cut a tubular and close the wellbore.

Accordingly, shearing members 5 are placed opposing each other on the inner ends of push rods 3, which are connected to operating pistons 8. The hydraulically activated operating pistons cause the shear members 5 to cut the tubular through wellbore 62 and to effectively seal wellbore 62. In one embodiment, each push rod 3, piston 8, and operating piston shaft 58 are monolithically constructed as one solid metal component as illustrated.

Bonnet end caps 60 contain bonnet hydraulic pistons 63 that are utilized to open the bonnets to change out shearing members 5. For this purpose, bolts 70 (See FIG. 2) can be loosened and hydraulic fluid pumped into the "Open" port (which in one embodiment may be port 74) to move the bonnets 4 on one or both sides outward to allow access to the shearing members. Bonnet hydraulic pistons are commonly used on BOPs to allow more conveniently changing out the shearing members due to the heavy weight of the bonnets. Otherwise lifting lines and/or cranes might be needed for this purpose with the need to pull apart the components and then align them to reinstall the bonnets. Various lifting lines and so forth may be used for lifting heavy shearing members 5 once the bonnets are open.

It will be noted that operating piston housing 61 and operating piston 8 are positioned between bonnet end caps 60. Therefore operating piston 8 is limited in diameter by distance 84 (See left side of FIG. 1), the minimum distance between the bonnet endcaps 60. In some cases, it would be desirable to provide additional force acting on push rods 3. As discussed above, booster pistons have been mounted within the bonnet end caps 60 in the past but the booster piston are then smaller in diameter than the operating piston.

Figure 4:
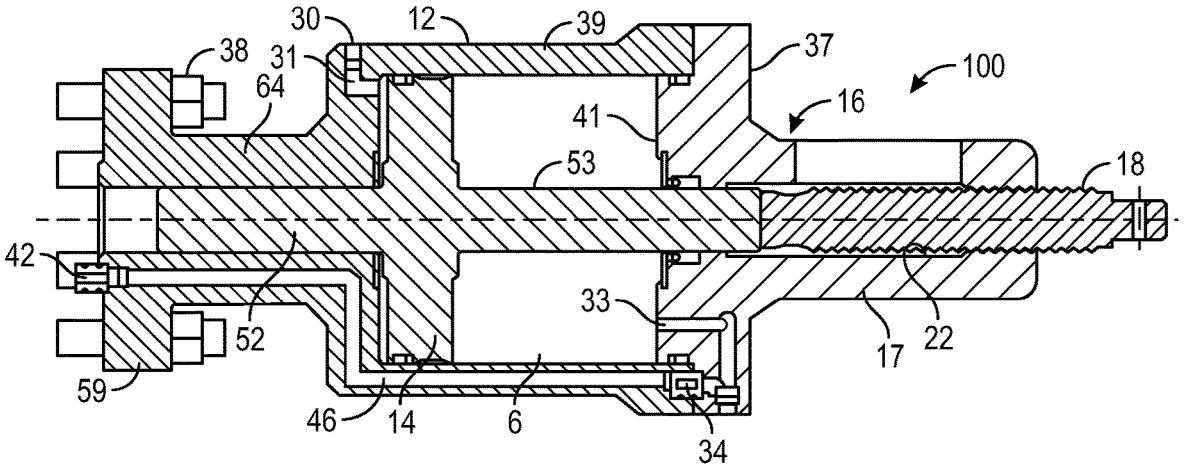
FIG. 4 is a top plan view, in section, of a booster piston assembly in accord with one possible embodiment of the present invention.

Referring also to FIG. 4, in accord with the present invention, booster pistons the same diameter or larger diameter than the operating pistons can be utilized in series in accord with the present invention. Booster piston housing 12 comprises booster housing extension 64 of sufficient extension length 82 (see FIG. 1) depending on the BOP size that positions or places booster piston chamber 6 axially outside of the ends of booster end caps 60 with respect to wellbore 62. Booster piston 14 is contained within the portion of booster housing 12 that defines booster piston hydraulic chamber 6. Booster piston hydraulic chamber 6 is sized to permit reciprocal motion of booster piston 14 that is the same distance but axially spaced from the reciprocal motion of operating piston 8.

In a preferred embodiment, booster piston 14 comprises a monolithic piston and rod construction whereby piston 14, inner shaft 52, and outer shaft 53 are constructed in one monolithically forged and/or machined metal piece. Inner shaft 52 is monolithically formed of metal on an inner side of piston 14 with respect to wellbore 62 and outer shaft 53 is monolithically formed of metal on the opposite side or outer side of piston 14 with respect to wellbore 62. The three components piston 14, inner shaft 52, and outer shaft 53 form a continuous metal construction e.g., forged and/or machined from a single metal component. In one embodiment of the present invention, the same seals used with operating piston 8 can also be used with booster piston 14.

At least the portion of booster housing 12 containing booster piston 14, namely booster piston hydraulic chamber 6, is positioned radially outwardly from bonnet end caps 60. Booster housing outer diameter 88 is greater than the minimum distance 84 between bonnet end caps. For this purpose, an extension length 82 is necessary for booster housing extension 64 taking also the width of booster housing flange 59 into consideration, which depends on the size of the BOP, so that booster piston chamber 6 is positioned radially outwardly from bonnet end caps 60 with respect to wellbore 62. Booster piston chamber 6 is the volume in which piston 14 is reciprocal and at a minimum is the length of the stroke of booster piston 14. The region of reciprocal movement of booster piston 14 is the region of booster piston chamber 6 which is positioned radially outside the outer end of bonnet end caps 60 to allow the diameter of booster piston 14 to be the same or larger than the diameter of operating piston 8.

Booster housing 12 comprises booster housing extension 64 that is preferably monolithically formed of metal as part of booster housing flange 59. Booster housing flange 59 is mostly round with flat surfaces to fit between bonnet end caps 60 (See FIG. 5) but could have other flange configurations such as rectangular. Booster housing flange 59 is secured to BOP 98 on the outer surface of bonnet housing outer wall surface 57 with fasteners 38. Note that bonnet housing outer wall surface 57 is the outer surface of operating piston chamber outer wall 43. Booster housing flange 59 and booster housing extension 64 are preferably also monolithically formed of metal with booster housing cylinder wall 39 that surrounds piston chamber 6 to be a single metallic uniform construction. While one or more separate components could be utilized to construct booster housing 12, in a preferred embodiment, booster housing 12 monolithically incorporates booster housing flange 59, booster housing extension 64, and booster housing cylinder wall 39 that surrounds booster piston chamber 6. In this preferred embodiment, booster housing 12 does not include the booster piston chamber outer end wall 41, which is part of booster housing end plate 16. In this preferred embodiment, the main three components of booster assembly 100 are the monolithic piston 14 with rods extending on both sides, booster housing 12, and booster housing end plate 16.

As noted, booster housing flange 59 is secured to the outer surface of operating piston chamber outer end wall 43. Because of this preferred construction, mounting bolts are not required that extend through operating piston housing 61 or otherwise connect to central BOP housing 50 as utilized in some prior art devices. Booster piston shaft 52 and operating piston shaft 58 are axially aligned with each other to work in concert and move along the same axis together by the same amount to increase the shearing capability of shearing members 5 during operation.

Operating piston shaft 58 extends through an opening in operating piston chamber outer wall 43. Shaft seal 91 in operating piston chamber outer end wall 43 seals around operating piston shaft 58 so that piston shaft 58 extends through booster housing flange 59 and into booster housing extension 64. In one embodiment, booster piston shaft 52 and operating piston shaft 58 engage with each other but are not secured together. The two shafts engage each other within booster housing extension 64.

The hydraulic fluid flow is shown diagrammatically and discussed again with respect to FIG. 10. However, in operation of this embodiment of the invention, to close shear members 5 of BOP booster piston assembly 100 and sever a tubular in wellbore 62, hydraulic fluid is introduced to port 74 (which in one embodiment may be the "open" port) from a hydraulic source such as a "close" accumulator. The hydraulic fluid flows into the hydraulics of the corresponding bonnet end cap 60 and is directed to the outer portion of operating piston chamber 48 on the outer side of piston 8. The hydraulic force moves operating piston 8 inwardly towards wellbore 62.

The hydraulic fluid also flows from the outer portion of operating piston chamber 48 to booster internal hydraulic fluid line 46 that connects through operating piston chamber outer wall 43 to hydraulic fluid on the outward side of operating piston 8. Booster piston assembly 100 includes booster hydraulic connector 42 for this purpose (See FIG. 3). The fluid then goes through internal hydraulic fluid line 46 through booster housing cylinder wall 39 to supply hydraulic fluid into outer booster piston chamber 6 on the outer side of booster piston 14. The hydraulic force moves booster piston 14 and booster piston shaft 52 and operating piston shaft 58 inwardly. Booster piston shaft 52 engages operating piston shaft 58 at operating piston shaft outer end 54. In a preferred embodiment, booster piston shaft 52 is not fixedly attached to operating piston shaft 58. Using the combination of two axially oriented pistons, namely operating piston 8 and booster piston 14, essentially doubles the shearing force of shearing members 5 assuming the two pistons have the same diameter and the same hydraulic pressure is utilized. The optimal or maximum hydraulic fluid pressure is limited but using multiple pistons provides twice the force without changing the hydraulic fluid pressure.

To open shear members 5 of BOP booster piston assembly 100, hydraulic fluid is applied to port 72 (which in one embodiment may be the "open" port. The "open" hydraulic fluid source may be from an "open" accumulator or other source of hydraulic fluid. Hydraulic fluid goes to the corresponding hydraulics contained in corresponding bonnet end caps 60 from which the fluid is supplied to piston port 65 on the inner side of operating piston 8 within operating piston chamber 48. The hydraulic force moves operating piston 8 outwardly from wellbore 62. Operating piston shaft 58 moves booster shaft 52 outwardly so that closure members 5 are also moved to the open position and wellbore 62 is open. It is not necessary to direct fluid to the booster piston for opening purposes since not as much force is required to move the pistons to the open position. Therefore, in this embodiment it is not necessary to utilize an additional hydraulic line to move the booster pistons to the position. The operation and hydraulic flow of booster piston assembly 100 and operating piston 8 will also be described with reference to the hydraulic fluid flow diagram of FIG. 10.

Figure 7:
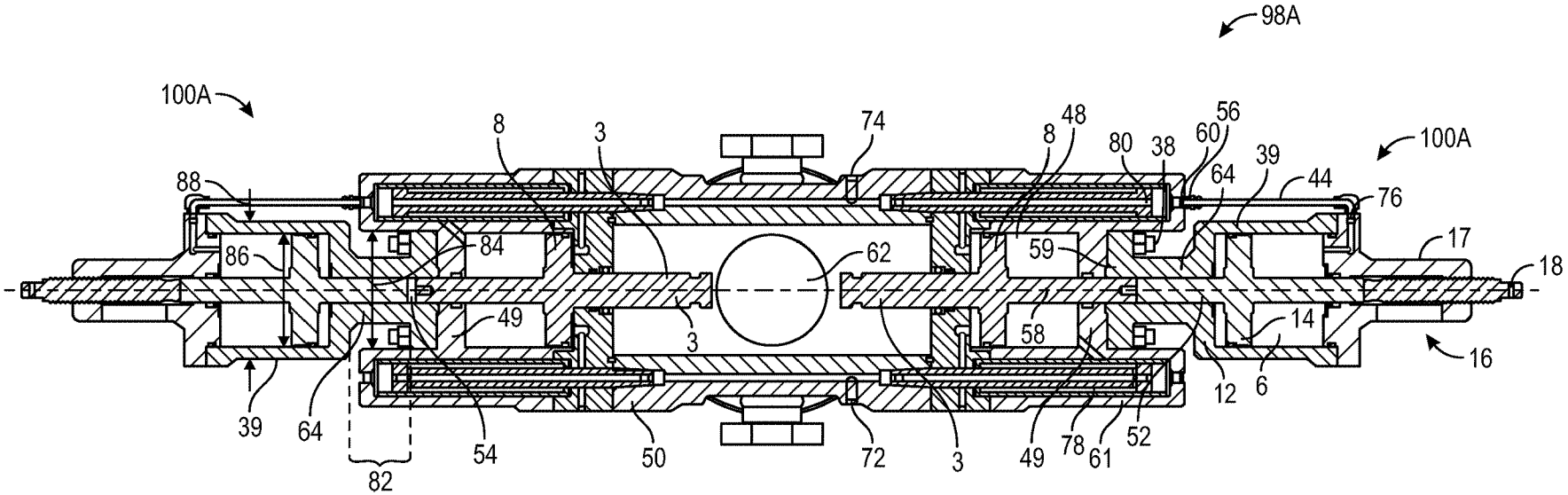
FIG. 7 is a top plan view, in section, of a shear BOP with a retrofit booster piston assembly in accord with one possible embodiment of the present invention.

FIG. 1 shows an embodiment of booster piston assembly 100 that utilizes internal hydraulic fluid line 46. FIG. 7 shows another embodiment, namely booster assembly 100A, which utilizes an external hydraulic line 44 as may be required for retrofit applications which may connect through hydraulic components 80 in one bonnet end cap 60 without use of hydraulic components in the other bonnet end cap. Accordingly, as shown herein an appropriate Booster Piston Assembly is provided that may be added to existing BOPs with external hydraulic lines as depicted in FIG. 7 or using internal hydraulic lines as depicted in FIG. 1.

FIG. 2 depicts a perspective view of BOP booster piston assembly 100 as seen in FIG. 1 wherein BOP 98 with booster piston assembly 100 is assembled on both ends of BOP 98 opposite each other. The configuration of FIG. 2 utilizes the internal hydraulic line to supply fluid to the booster piston and avoids external hydraulic lines that could be damaged or broken during operation. To install booster piston assembly 100, booster hydraulic connector 42 (See FIG. 4) is connected to a port on operating piston chamber outer wall 43 as indicated on the right side of FIG. 1. Booster housing flange 59 is secured to operating piston chamber outer wall 43 utilizing fasteners 38. Hoist rings 40 are used to assist in hoisting and placing booster assembly 100 in proper position with respect to BOP 98.

Figure 5:
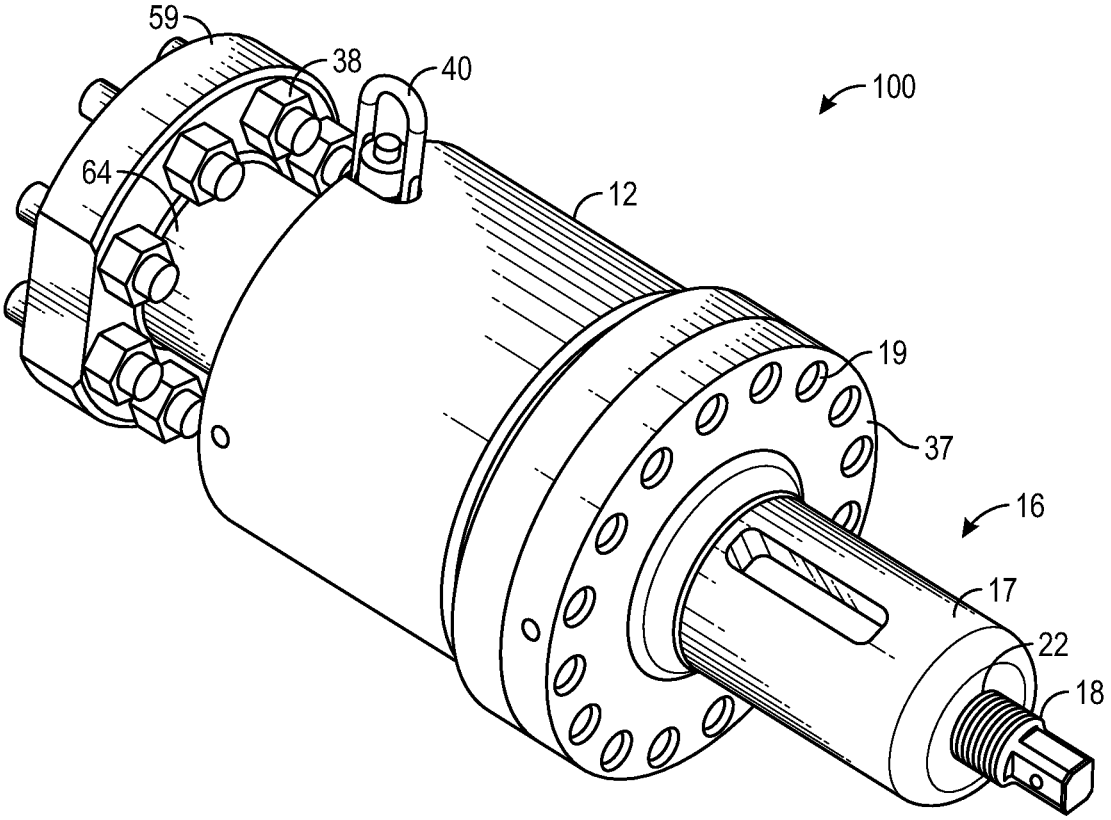
FIG. 5 is a perspective view of a booster piston assembly in accord with one possible embodiment of the present invention.

FIG. 4 and FIG. 5 show an enlarged view of a preferred booster assembly 100 that has the three main monolithic components discussed hereinbefore, namely the booster housing 12, piston 14 and shafts, and booster end plate 16. While booster piston assembly 100 could be built differently, the preferred construction requires only three main components making assembly and disassembly quicker. The components made monolithic are believed to be the most efficient combinations to avoid the need for spacers, connectors, and so forth as is used in the prior art.

Booster end plate 16 is preferably a monolithic construction of booster piston chamber outer wall 41, booster end plate flange 37, and booster end plate housing 17. End plate 16 is secured to booster housing 12 via flange 37 (see FIG. 5) utilizing fasteners 19. Booster end plate housing 17 includes internal threaded portion 22 (See FIG. 4). Booster lock screw 18 can be inserted and rotated to manually lock the pistons and shear members in the closed position if desired.

Figure 10:
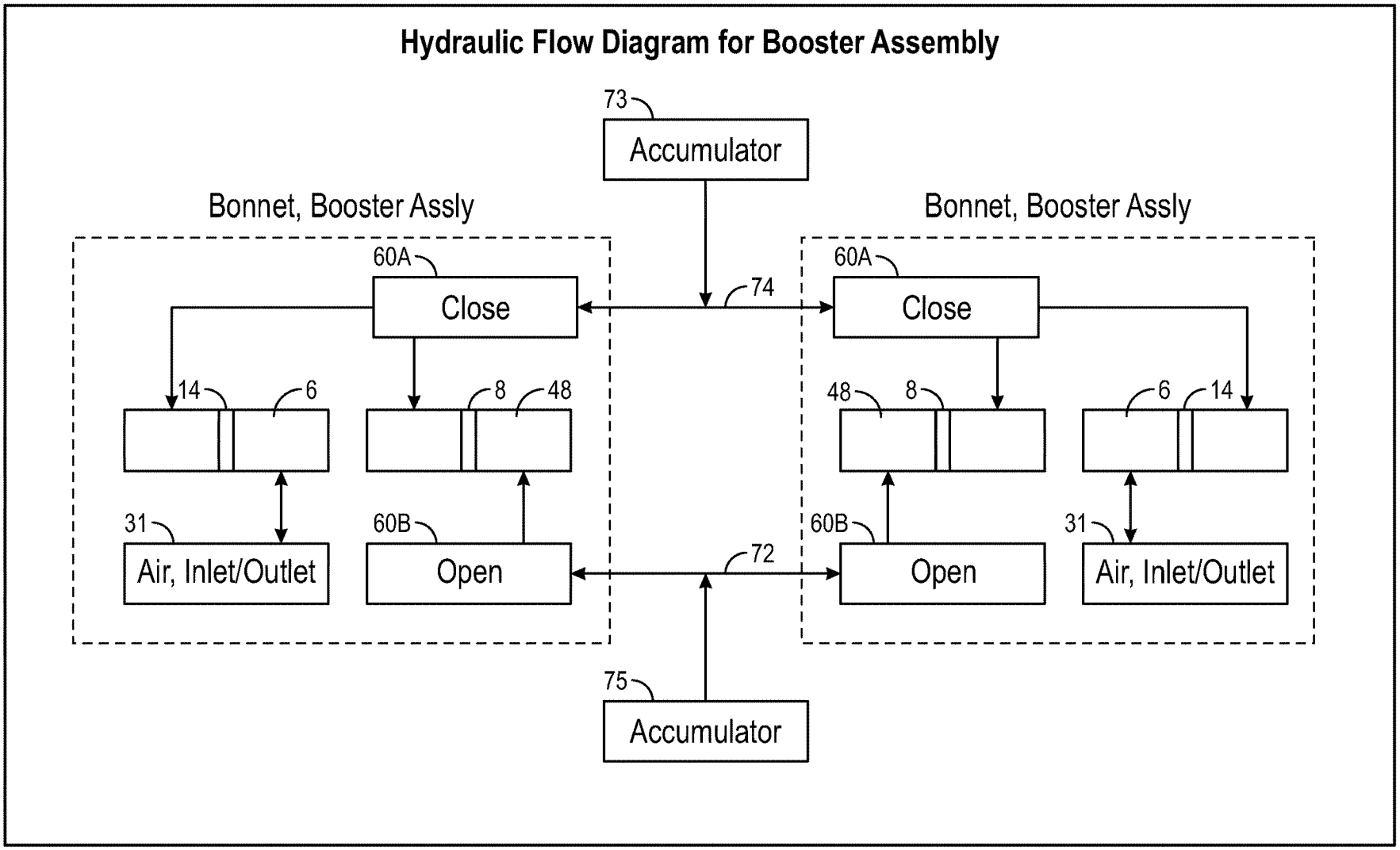
FIG. 10 is a hydraulic fluid flow path diagram in a shear BOP with booster piston assembly.

FIG. 4 depicts a sectional view of booster piston assembly 100 whereas FIG. 5 is the outer perspective view. As discussed above, booster hydraulic connector 42 connects to the corresponding hydraulic line port from the operating piston chamber 48 in BOP 98. This connection provides hydraulic fluid through booster internal hydraulic fluid line 46, hydraulic connector port 34, and through booster cylinder port 33 to the outer side of booster piston chamber 6 on the outer side of piston 14 for energizing booster piston 14 to move to close the BOP. Booster cylinder port 33 is formed in booster piston chamber outer wall 41 as part of booster end plate 16. In this way, hydraulic fluid is introduced at the outermost side of booster piston chamber 6. As piston 14 is pushed inwardly toward the wellbore, fluid such as air, depending on the application, will be pushed through passageway 31 and air breather filter 30 to vacate the inner piston side of chamber 6. When booster inner piston shaft 52 is moved outwardly by operating piston shaft 58 as explained earlier, then the air flows through filter 30 and allows booster piston 14 to move outwardly and push hydraulic fluid out of one or more booster cylinder ports 33 back through internal hydraulic fluid line 46 that flows into operating piston housing 48 and then out through close BOP port 74 (See FIG. 1). An overview of the hydraulic fluid system is shown in FIG. 10.

Figure 3:
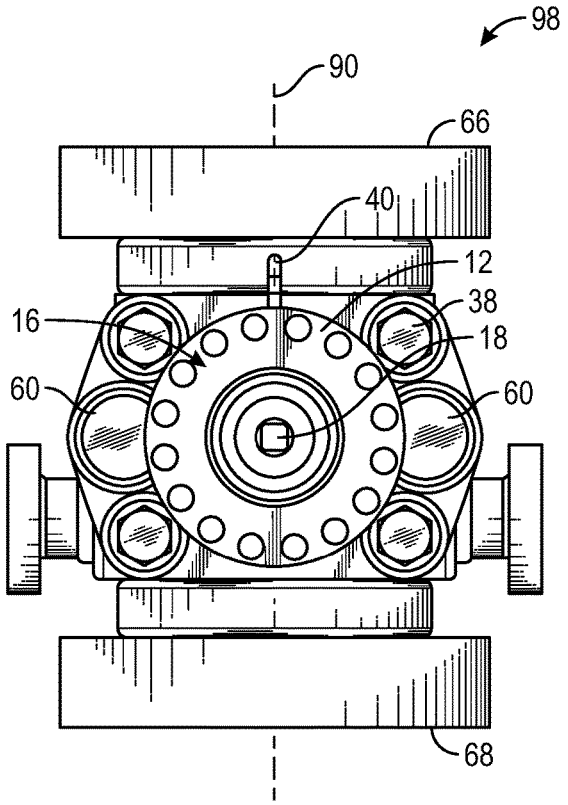
FIG. 3 is a side elevational end view of a shear BOP with booster piston assembly in accord with one possible embodiment of the present invention.

Turning to FIG. 3, an end view of a BOP booster assembly 100 is shown in accordance with the present invention. Upper flange 66 and lower flange 68 are utilized to secure BOP 98 into the BOP stack. Wellbore 62 extends through the upper and lower flanges. Booster end plate 16 is shown with lock screw 18 in position. Lock screw 18 may be utilized to manually lock the shear members 5 in the closed position by rotating lock screw to engage booster piston outer shaft 53 when booster piston 14 is in the closed position. Bolts 38 secure bonnet 4 to BOP 98. As discussed above, bolts 38 may be removed so that the hydraulic assembly in bonnet end caps 60 can be utilized to open the bonnet to change out closure members 5 as is known to those of skill in the art. The maximum outer diameter of booster housing 12 shown in FIG. 1 as distance 88 is greater than the minimum distance between the bonnet end caps 60, which distance is shown in FIG. 1 as distance 84.

Figure 6:
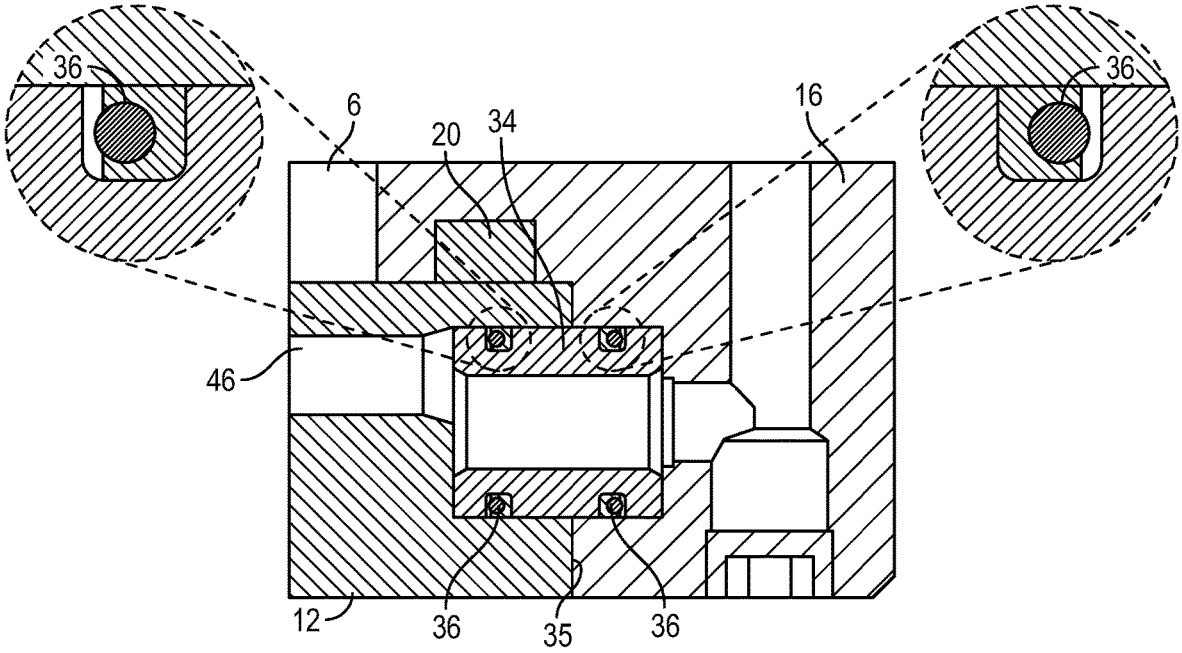
FIG. 6 is a sectional view of a booster piston assembly end plate sealing arrangement, in section, in accord with one possible embodiment of the present invention.

Looking now to FIG. 6, the sealing arrangement for booster assembly 100 is shown whereby hydraulic connector port 34, a sealing unit, is positioned in fluid communication with internal hydraulic fluid line 46 between booster housing 12 and end plate 16 to seal interface 35 between these components. Connector port 34 is utilized to provide a seal for internal hydraulic fluid line 46 where booster housing end plate 16 connects with booster housing 12 at interface 35. Connector port 34 prevents leaks at interface 35. Polypak seals 36 on either side of interface 35 and lip seal 20 are provided to ensure integrity in the sealing arrangement with connector port 34 during operation. Connector port 34 aligns with internal hydraulic line 46 to allow hydraulic fluid to flow into hydraulic chamber 6 while preventing leaks through interface 35.

Turning now to FIG. 7, an embodiment of BOP 98A is depicted with retrofit booster piston assembly 100A on both sides of BOP 98A. This embodiment utilizes an external hydraulic line 44 connection to the booster piston assembly rather than an internal hydraulic connection from the operating piston chamber as used with BOP 98. Otherwise this assembly is essentially the same in construction. In this example, an Otherwise this assembly is essentially the same in construction. In this example, an external hydraulic line 44 is utilized to connect between a bonnet cap 60 that contains hydraulics for closing the rams and retrofit booster piston assembly 100A. As described earlier regarding FIG. 1, BOP 98A also comprises housing 50 with operating pistons 8 utilized to control wellbore 62. Shearing members 5 (See FIG. 1) are placed opposing each other on rods 3 to shear a tubular extending through wellbore 62.

Figure 8:
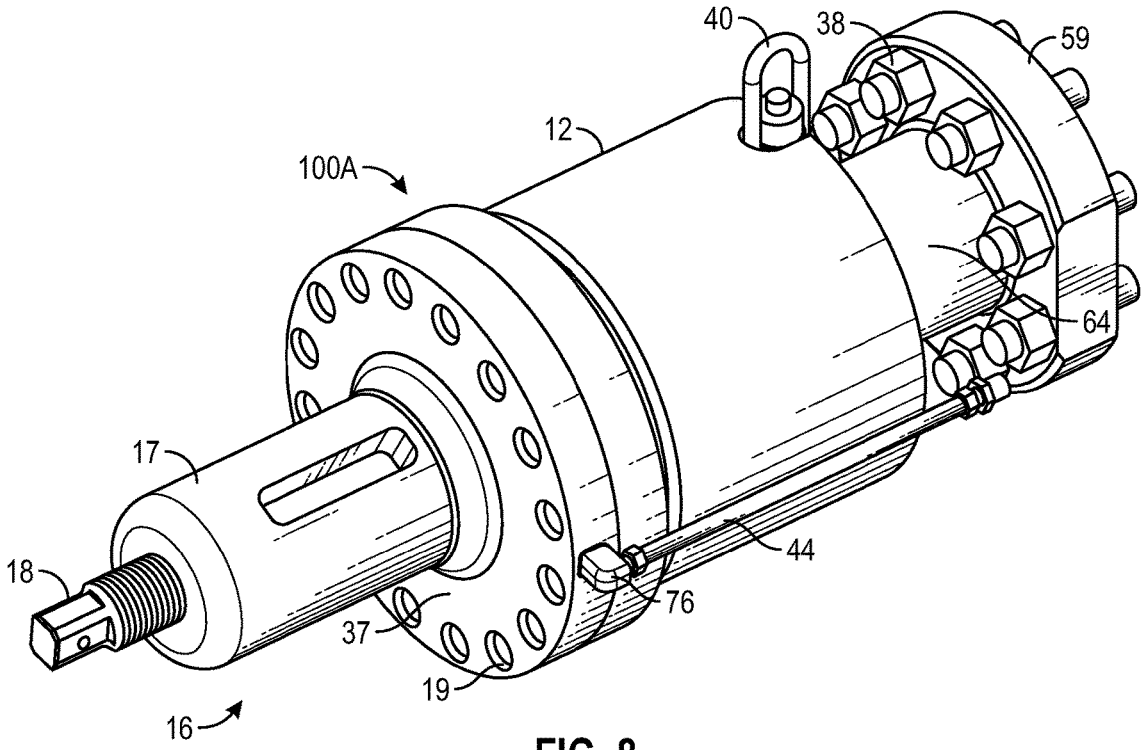
FIG. 8 is a perspective view of a retrofit booster piston assembly in accord with one possible embodiment of the present invention.
Figure 9:
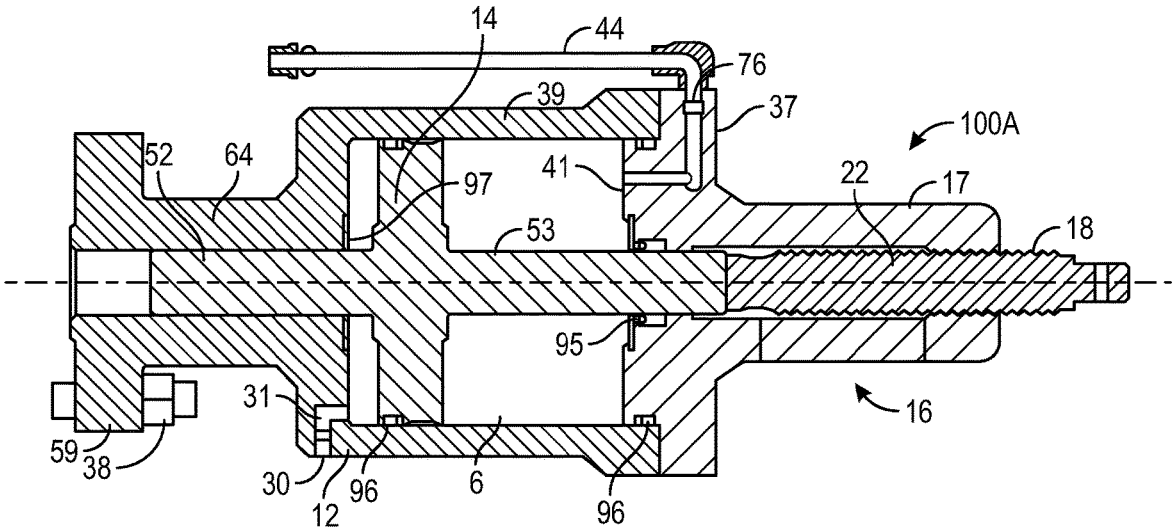
FIG. 9 is a top plan view, in section, of a retrofit booster piston assembly in accord with one possible embodiment of the present invention.

Accordingly, FIGS. 7, 8, & 9 show the embodiment of BOP 98A depicted with a booster piston assembly 100A that may be utilized with existing BOPs that can be retrofitted for operation with booster piston assembly 100A. FIG. 8 is a perspective view of booster piston assembly 100A designed to be retrofitted onto an existing BOP that does not include a hydraulic connection in operating piston chamber outer wall 43 for an internal hydraulic line in the booster piston assembly as described with respect to FIG. 1-4. Booster piston assembly 100A operates in the same way as booster piston assembly 100 except for the external hydraulic line.

As described hereinabove, booster piston assembly 100A comprises cylindrical housing 12 and booster housing end plate 16 which define booster chamber 6 containing booster piston 14. End plate housing 16 is secured to booster housing 12 utilizing booster end plate housing 17, booster end plate flange 37, and associated fasteners 19. Lock screw 18 may be utilized with threaded portion 22 to secure booster piston 14 in place. Booster housing flange 59 is provided with suitable fasteners such as nuts 38 to secure booster assembly 100A to BOP 98A. Booster housing 12 connects to the outer surface of the operating piston chamber 48. Conveniently this construction does not require long bolts that extend through to the BOP housing 50 as booster piston assemblies of some prior art devices. External hydraulic line 44 connects with the BOP to provide the hydraulic force to energize piston 14.

FIG. 9 shows a sectional view of booster piston assembly 100A whereas FIG. 8 shows an external view. Seals may be used in the booster assembly that are the same as those used with the operating piston. This may include booster piston seals 96, booster outer piston shaft seal 95 as it extends through the opening in booster piston outer wall 41 that is monolithically part of booster end plate flange 37, and booster inner piston shaft seals 97 where shaft 52 enters the opening in extension portion of booster housing 12. Seals 96 are provided to seal booster piston chamber 6 with booster housing end plate 16.

External hydraulic line 44 is provided to operatively connect booster piston assembly 100A with BOP 98A to control movement of booster piston 14. External hydraulic line 44 connects to external line fitting 76 in end plate 16, which provides hydraulic fluid access at the outer end of booster piston chamber 6 with the hydraulic passageway formed in end plate 16. As piston 14 moves inward due to hydraulic fluid pressure, air or fluid is vacated from chamber 6 through passageway 31 and breather filter 30. Breather filter 30 prevents foreign objects from invading chamber 6 and damaging booster assembly 100 or 100A.

Booster piston 14 preferably comprises a monolithic piston and rod construction whereby piston 14 and shafts 52, 53 are constructed as one metallic piece. Booster housing 12 is secured to BOP 98 with fasteners 38 in booster housing flange 59 between bonnet end caps 60. Booster piston shaft 52 engages operating piston shaft 58 at operating piston shaft outer end 54. The booster piston and operating piston are aligned with each other to work simultaneously with the same motion to increase the shearing capability of the shearing rams during operation. When the booster piston and operating piston are the same diameter, the force is approximately doubled. In a preferred embodiment, booster piston shaft 52 is not fixedly attached to operating piston shaft 58. However, in other embodiments, booster shaft 52 and operating shaft 58 may be removably connected with each other. As described hereinbefore, booster housing extension 64 is sufficiently long so that booster piston chamber 6 is positioned radially outside of bonnet end caps 60. This allows diameter 86 of booster piston to be as large as or greater in diameter than operating piston 8.

Looking to FIG. 10, the flow of hydraulic fluid and operation of BOP booster piston assembly is depicted. In this embodiment, a hydraulic source such as "close" accumulator 73 is activated to close the BOP rams. Another hydraulic source such as "open" accumulator 75 may be utilized to open the BOP rams. The same hydraulic ports 74 and 72 and flow lines can be utilized to operate the BOP rams and to open the bonnet to change out the shear members.

In this description, the bonnet end caps 60 are referred to herein as close bonnet end caps 60A that contain therein hydraulic systems to direct hydraulic fluid to close the rams and open bonnet end caps 60B that contain therein hydraulic systems to direct hydraulic fluid to open the rams.

To close the rams, hydraulic fluid flows from "close" accumulator 73 to port 74 into the hydraulic elements within close end caps 60A. The hydraulic fluid is then directed to the outer sides of operating piston 8 and booster piston 14. Air escapes from the inner side of booster piston 14 through air breather 31 as the booster piston 14 is moved toward the well bore to close the rams. Hydraulic fluid on the inner side of operating piston 8 is expelled to "open" accumulator 75. As discussed above, with the internal hydraulic line embodiment of FIG. 1-4, during closing the activating hydraulic fluid flows from the outer side of piston 8 to the outer side of booster piston 14. In the retrofit embodiment of FIG. 7-9, the hydraulic fluid flows from close end caps 60A through a retrofit hydraulic line to the outer side of booster piston 14.

To open the rams, hydraulic fluid flows from "open" accumulator 75 to port 72 to the hydraulic elements within open end caps 60B. The hydraulic fluid is then directed only to the inner side of operating pistons 8. Operating pistons 8 then move outwardly and the connecting piston rods described hereinbefore push booster pistons 14 outwardly to the open position. Hydraulic fluid is expelled in the reverse direction to accumulator 73 as described above. Air is taken into the inner side of booster chamber 6 through inlet 31 as booster piston 14 is moved to the open position.

Accordingly as discussed above, to close BOP 98 or 98A and shear a tubular or other member in wellbore 62, "close" BOP accumulator 73 moves hydraulic fluid through BOP 98 into an outer portion of operating piston chamber 48 thereby moving operating piston 8 towards wellbore 62 to move shearing members 5 into engagement with each other with the tubular or other member therebetween. This action cuts the tubular and seals the wellbore.

In the internal hydraulic line embodiment of FIG. 1-4, hydraulic fluid flows from the outer portion of operating piston chamber 48 to the outer portion of booster piston chamber 6 through internal hydraulic line 46.

In the external hydraulic line embodiment of FIG. 7-10, hydraulic fluid flows from the hydraulics covered by close bonnet end caps 60A (see FIG. 10) directly to the outer portion of booster piston chamber 6 through external hydraulic line 44.

To open BOP 98 or 98A, "open" accumulator 75 supplies hydraulic fluid into the inner portion of piston chamber 48 on the inner side of operating piston 8 to move piston 8 outwardly away from wellbore 62. This movement causes operating piston shaft 58 that is engaged with booster shaft 52 to move both operating piston 8 and booster piston 14 outwards away from wellbore 62 to move the shearing members away from wellbore 62 to open the BOP rams.

In one embodiment, the booster piston is at least as large as, preferably equal to, but could be larger than the operating piston. The booster piston housing has a larger outside diameter than the distance between the bonnet end caps and is positioned beyond the bonnet end cap utilizing booster housing extension 64 of booster housing 12.

The present invention is used with shear members in BOPs that comprise hydraulic bonnets with hydraulically activated pistons inside the bonnet end caps utilized to open the BOPs to change out the shear members. The use of a booster piston assembly as described herein allows a smaller diameter BOP that can be utilized to cut pipe that in the past required a much larger and typically much more expensive BOP. However, the invention may be utilized in any size BOP such as but not limited to 11", 13⅝", 18¾, or 21¼ inch as desired.

As discussed above, the booster assembly has three main components that are believed constructed in the most efficient combination of parts and functions.

The first component is a booster housing that monolithically incorporates a booster housing flange 59 that attaches to the BOP at the outer surface of the operating piston chamber outer wall, an extension 64 connecting to the flange, and a booster housing cylinder wall 39 that contains therein the entire booster cylinder chamber 6 in which the booster piston 14 reciprocates.

The second component is a piston 14 monolithically incorporating an inner piston shaft 52 and an outer piston shaft 53 in a single metal construction. The inner piston shaft 52 engages the outer shaft or operating piston shaft 58 of the operating piston 8. The outer booster piston shaft 53 extends through an opening in the booster housing end plate 16 to provide a visual indication of the open or closed position and also can be locked in the closed position with a lock screw 18.

The third component is a booster housing end plate 16 that monolithically incorporates the booster piston chamber outer wall 41 with hydraulic fluid lines therein and preferably forms a flange 37 for attachment to the booster housing. The booster housing end plate 16 further monolithically incorporates the booster end plate housing 17 with an opening for the outer piston shaft 53 and threads for the lock screw.

In a preferred embodiment, only the operating piston is connected to pressurized hydraulic fluid from the "open" accumulator for opening.

In one embodiment, a hydraulic transition connector 34 is utilized in the hydraulic fluid line 46 that connects the booster housing to the booster end plate to prevent leaks at the interface 35 between booster housing 12 and booster housing end plate 16.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A booster piston assembly for use with a BOP, said BOP comprising a central body, on one side of said central body of said BOP comprises a shear member and an operating piston to move said shear member between an open and closed position, an operating piston shaft, a bonnet comprising two bonnet end caps, said two bonnet end caps containing hydraulics to open said bonnet for access to an interior of said central body, said operating piston being mounted between said two bonnet end caps within an operating piston chamber, said operating piston chamber comprising an operating piston chamber outer wall, said booster piston assembly comprising:

a booster piston housing, said booster piston housing comprising a booster housing extension and a booster cylinder wall that encircles a booster piston chamber, said booster piston housing further comprising a booster flange, said booster flange and said booster housing extension are positioned between said two bonnet end caps, said booster flange, said booster housing extension, and said booster cylinder wall being monolithically formed without joints between said booster flange, said booster housing extension and said booster cylinder wall, said booster housing extension being positioned between said booster flange and said booster cylinder wall;

a booster piston mounted for reciprocal movement inside said booster piston chamber, said booster piston comprising a diameter at least as large or greater than a diameter of said operating piston; and an inner booster piston shaft and an outer booster piston shaft on opposite sides of said booster piston, said inner booster piston shaft, said booster piston, and said outer booster piston shaft being monolithically formed without joints between said inner booster piston shaft, said booster piston, and said outer booster piston shaft.

2. The booster piston assembly of claim 1, further comprising said booster housing extension comprising a smaller outer diameter than said booster flange and said booster cylinder wall.

3. The booster piston assembly of claim 2, further comprising a booster housing end plate, said booster housing end plate comprising a booster piston chamber outer wall, a booster end plate flange, and a booster end plate housing, said booster outer piston shaft extending into said booster end plate housing, said booster inner piston shaft extending into said booster housing extension.

4. The booster piston assembly of claim 3 wherein said booster inner piston shaft is positioned to engage said operating piston shaft but is not fastened to said operating piston shaft when said booster piston housing is secured to said BOP.

5. The booster piston assembly of claim 1, wherein a circumference of said booster cylinder wall comprises an outer diameter greater than a minimum distance between said two bonnet end caps.

6. The booster piston assembly of claim 1, wherein said booster flange and said booster housing extension comprise an axial length that positions said booster cylinder wall axially spaced away from said two bonnet end caps when said booster piston housing is secured to said BOP.

7. The booster piston assembly of claim 1, wherein said booster cylinder wall defines an internal hydraulic line therein that receives hydraulic fluid to move said operating piston to a closed position, said booster piston and said operating piston being connected to move simultaneously the same distance in the same direction.

8. A booster piston assembly for use with a BOP, said BOP comprising a central body, on one side of said central body of said BOP comprises a shear member and an operating piston to move said shear member between an open and closed position to open and close a bore through said central body, an operating piston shaft, a bonnet comprising two bonnet end caps, said two bonnet end caps containing hydraulics to open said bonnet for access to an interior of said central body, said operating piston being mounted between said two bonnet end caps within an operating piston chamber, said operating piston chamber comprising an operating piston chamber outer wall, said booster piston assembly comprising:

a booster piston housing comprising a booster flange adapted to be mounted to said operating piston chamber outer wall, said booster piston housing defining a booster piston chamber, a booster piston mounted for reciprocal movement inside said booster piston chamber, said booster piston comprises a diameter at least as large or greater than a diameter of said operating piston, whereby when said booster flange is mounted to said BOP then said booster piston is operatively connected to said operating piston, said booster piston housing further comprises a booster housing extension, wherein when said booster flange is mounted to said operating piston chamber outer wall, then said booster flange and said booster housing extension comprise an axial length that axially positions said booster piston chamber axially outside of the outermost ends of said two bonnet end caps with respect to a center of said bore through said central body, said booster piston and said operating piston being connected to move simultaneously in the same direction, said booster flange and said booster housing extension are positioned between said two bonnet end caps;

said booster piston housing further comprises a booster cylinder wall surrounding said booster piston chamber; and said booster flange, said booster housing extension, and said booster cylinder wall being monolithically formed of metal without joints between said booster flange, said booster housing extension, or said booster cylinder wall, said booster housing extension comprising a smaller outer diameter than said booster flange and said booster cylinder wall.

9. The booster piston assembly of claim 8, wherein a circumference of said booster cylinder wall comprises an outer diameter greater than a minimum distance between said two bonnet end caps, said booster piston and said operating piston moving the same distance.

10. The booster piston assembly of claim 8, wherein within said booster cylinder wall is an internal hydraulic fluid line extending along an entire length of said booster piston chamber, said internal hydraulic fluid line is fluidly connected to said booster piston chamber on an outward side of said booster piston with respect to said BOP when said booster piston housing is mounted to said BOP.

11. A booster piston assembly for use with a BOP, said BOP comprising a central body, on one side of said central body of said BOP comprises a shear member and an operating piston to move said shear member between an open and closed position to open and close a bore through said central body, an operating piston shaft, a bonnet comprising two bonnet end caps, said two bonnet end caps containing hydraulics to open said bonnet for access to an interior of said central body, said operating piston being mounted between said two bonnet end caps within an operating piston chamber, said operating piston chamber comprising an operating piston chamber outer wall, said booster piston assembly comprising:

a booster piston housing adapted to be mounted to said BOP between said two bonnet end caps, said booster piston housing comprising a booster cylinder wall that encircles a booster piston chamber, a booster piston mounted for reciprocal movement inside said booster piston chamber, whereby when said booster piston housing is mounted to said BOP then said booster piston is operatively connected to said operating piston so that said booster piston and said operating piston move axially together, said booster piston comprises a diameter at least as large or greater than a diameter of said operating piston; and said booster piston housing comprising a booster flange, a booster housing extension, and said booster cylinder wall, said booster flange, said booster housing extension and said booster cylinder wall being monolithically formed of metal without joints between said booster flange, said booster housing extension, and said booster cylinder wall, said booster flange and said booster housing extension are sized to be positioned between said two bonnet end caps; and a circumference of said booster cylinder wall comprises an outer diameter greater than a minimum distance between said two bonnet end caps, said booster piston and said operating piston moving the same distance.

12. The booster piston assembly of claim 11, further comprising an inner booster piston shaft and an outer booster piston shaft on opposite sides of said booster piston, said inner booster piston shaft, said booster piston, and said outer booster piston shaft being monolithically formed of metal without joints between said inner booster piston shaft, said booster piston, and said outer booster piston shaft.

13. The booster piston assembly of claim 11, further comprising said booster cylinder wall defines therein a hydraulic fluid line that extends along an axial length of said booster piston chamber, said hydraulic fluid line is fluidly connected to said booster piston chamber on an outer side of said booster piston with respect to said BOP, said hydraulic fluid line being internal to said booster cylinder wall, said hydraulic fluid line being operably connected to an outer side of said operating piston.

14. The booster piston assembly of claim 11, wherein said booster piston housing further comprises said booster housing extension and said booster flange adapted to be mounted to said operating piston chamber outer wall.

15. A booster piston assembly for use with a BOP, said BOP comprising a central body, on one side of said central body of said BOP comprises a shear member and an operating piston to move said shear member between an open and closed position to open and close a bore through said central body, a bonnet comprising two bonnet end caps, said two bonnet end caps containing hydraulics to open said bonnet for access to an interior of said central body, said operating piston being mounted between said two bonnet end caps within an operating piston chamber, said operating piston chamber comprising an operating piston chamber outer wall, said booster piston assembly comprising:

a booster piston housing, said booster piston housing comprising a booster housing extension and a booster cylinder wall that encircles a booster piston chamber, said booster piston housing further comprising a booster flange adapted to be mounted to said operating piston chamber outer wall, said booster flange, said booster housing extension, and said booster cylinder wall being monolithically formed so there are no joints between said booster flange, said booster housing extension and said booster cylinder wall, said booster housing extension being positioned between said booster flange and said booster cylinder wall, said booster flange and said booster housing extension are positioned between said two bonnet end caps;

a booster piston mounted for reciprocal movement inside said booster piston chamber, said booster piston comprising a diameter at least as large or greater than a diameter of said operating piston; and wherein when said booster piston assembly is mounted to said BOP then the axially outermost ends of said two bonnet end caps extend axially outwardly away from a center of said bore through said central body by a first axial distance, said booster piston chamber is positioned at a second axial distance from said center of said bore through said central body that is greater than said first axial distance, said booster flange and at least a portion of said booster housing extension are positioned at a third axial distance from said center of said bore through said central body that is less than said first axial distance.

16. The booster piston assembly of claim 15 further comprising said booster housing extension extends away from said operating piston chamber outer wall such that said booster housing extension does not abut said operating piston outer chamber wall, said booster housing extension comprising a smaller outer diameter than said booster flange and said booster cylinder wall.

17. The booster piston assembly of claim 15 further comprising said booster piston comprises an inner booster piston shaft and an outer booster piston shaft, said inner booster piston shaft is not fixedly attached to said outer operating piston shaft.

* * * * *